United States Patent [19]

Goodin

[11] 4,195,371

[45] Apr. 1, 1980

[54] POOL CLEANING APPARATUS

[76] Inventor: Raymon L. Goodin, 2227 W. Overton, Tucson, Ariz. 85704

[21] Appl. No.: 939,175

[22] Filed: Sep. 5, 1978

Related U.S. Application Data

[63] Continuation-in-part of Ser. No. 773,681, Mar. 2, 1977, abandoned.

[51] Int. Cl.[2] ..... E04H 3/16

[52] U.S. Cl. ..... 4/172.15; 4/172.17; 134/102; 134/168 R

[58] Field of Search ..... 134/24, 36, 102, 166 R, 134/167 R, 168 R, 169 R; 210/169; 4/172.15, 172.16, 172.17, 416 AS

[56] References Cited

U.S. PATENT DOCUMENTS

| | | | |
|---|---|---|---|
| 3,045,829 | 7/1962 | Rule et al. | 210/169 |
| 3,247,968 | 4/1966 | Miller | 210/169 X |
| 3,449,772 | 6/1969 | Werner | 134/167 R |
| 3,506,489 | 4/1970 | Baker | 210/169 X |
| 3,615,013 | 10/1971 | Reece | 210/169 |
| 3,675,252 | 7/1972 | Ghiz | 134/168 R X |
| 3,765,432 | 10/1973 | Goodin | 134/168 R |
| 3,805,815 | 4/1974 | Goodin | 134/167 R |

*Primary Examiner*—Marc L. Caroff

*Attorney, Agent, or Firm*—Warren F. B. Lindsley

[57] ABSTRACT

An automatic cleaning apparatus for swimming pools in which one or more jet streams of liquid are maintained at or near the interior floor surface of the pool to agitate dirt settling to the floor of the pool. The jet streams are rotated 360 degrees through an air actuating mechanism with air being introduced into the jet streams intermittently to increase their agitating action and to help purify the pool liquid.

3 Claims, 4 Drawing Figures

POOL CLEANING APPARATUS

This application is a continuation in part of application Ser. No. 773,681, filed Mar. 2, 1977 and entitled "Pool Cleaning System", now abandoned.

BACKGROUND OF THE INVENTION

This invention relates to swimming pools and more particularly to automatic cleaning methods and apparatus which employ one or more jet streams of liquid originating at or near the interior surface of the pool to agitate dirt settling to the floor of the pool so that it may remain in suspension in the pool water and be pumped out of the pool and into the pool water filtering apparatus.

FIELD OF THE INVENTION

Existing automatic pool sweeping systems employ powerful water jets projected from sweeper hoses at the bottom of the pool to dislodge dirt and keep the water agitated until the dirt finds its way into the pool outlets.

Recently water outlet heads mounted in the pool side walls and bottom have produced jet streams that are rotated 360 degrees to help agitate and clean the pool water. These outlet heads employ complicated mechanisms to rotate the jet streams and do not purify the water of the jet streams in an aerating manner which is believed necessary to keep the pool water sparkling clean.

DESCRIPTION OF THE PRIOR ART

Existing automatic pool cleaning apparatus and methods employing jet streams of liquid to dislodge particles of dirt from the interior surface of the pool have been only partially effective.

U.S. Pat. No. 3,045,829 employs fixed jets, but the number of jets required to clean a pool is so great that a booster pump is necessary. Also, fixed jets stain the interior surface of the pool after a given period of time. The reason for staining is that pool water normally contains dissolved substances such as copper sulfate, iron oxides, and acids used to purify the water. When these substances are directed over the pool surface for a long period of time, a fan shaped stain will result.

U.S. Pat. No. 3,247,968 employs rotating jets. They either rotate too fast to be efficient or stop and do not rotate at all. Such rotating jet arrangements have the disadvantage in that the torque applied to the nozzle when sufficient to overcome the friction of the rotating nozzle at its bearing surface and the friction encountered when rotating through the water, will be so great that a undesirable speed of rotation is necessary. Such a high rotational speed of the jets is undesirable since the jet stream is forced into a spiral path in the pool liquid. This occurs because once the jet stream has left the nozzle the jet stream cannot move sideways through the pool water.

U.S. Pat. No. 3,506,489 employs jet streams of liquid that turn off and on in a fixed time relationship. One of the disadvantages of this is that the part of the pool that is not being cleaned is a dead spot and dirt that was suspended in the pool liquid is allowed to settle back to the pool floor. Another disadvantage is that when a jet stream of liquid is turned into a pool it takes several minutes for it to reach out to its full length. So, when a jet is turned off and then turned back on again it is far less efficient in the sweeping of a pool floor than a jet that is maintained on and rotated continually at ½ to 1 degree at a time.

SUMMARY OF THE INVENTION

The present invention overcomes the disadvantages and defficiencies of the methods and apparatus of the above identified patents. In accordance with the invention claimed, jet streams of liquid are mixed intermittently with air to produce turbulance in the jet streams and agitating action is created extending from the floor of the pool up its walls to the pool surface. This action cleans the surface of the upper walls of the pool. The fine air bubbles as they rise to the surface of the pool have a tendency to hold to leaves and keep them floating on the surface so that the normal action of the skimmer can remove them. The aerating of the liquid helps to purify it, so less chemicals are required for purification. The present invention allows the jets of water introduced into the pool for cleaning purposes to be turned by as little as ½ of a degree or less at a time thereby reducing the distance between the centers of the succesive jet stream when they have reaches out from their nozzles to near their full length. For instance, if a jet stream is rotated 1 degree at the point of origination, when it reaches 7' in length it has only moved approximately 1½" sideways from its point of origin, compared to a jet stream that is moved 20 degrees at its point or origination. When this later jet stream reaches 7' it has moved approximately 32" to the side from its point of origin. It is obvious that the present method is far more efficient.

One object of this invention is to provide better dirt detaching action by mixing air with the liquid jet stream. Another object is to increase the cleaning area of each jet stream by rotation of the jet stream ½ degree or less at a time.

Another object of this invention is to increase the ability of the jets to keep dirt and leaves on the surface of the pool so the skimmer can remove them. This is accomplished by the rising of fine air bubbles to the surface of the pool which during their movement have a tendency to move the dirt and leaves up to the pool surface with them.

Another object of this invention is to rotate the jets one step at a time without stopping the liquid flow to the jets, thereby eliminating the dead spots in the pool that would occur when some of the jets are turned off.

Another object of this invention is to rotate the jets one step at a time without stopping the flow of liquid to the jet streams, thereby eliminating the time loss that occurs when a jet stream is turned on and off since a jet stream that is turned on will take several minutes to reach out to near its full length. A jet stream that is maintained on all the time and moved ½ degree at a time will reach out to near its full length almost immediately. This is caused by the fact that a jet stream through liquid will tend to pull the liquid on either side in the same direction.

DESCRIPTION OF THE PREFERRED EMBODIMENT

Figure 1:
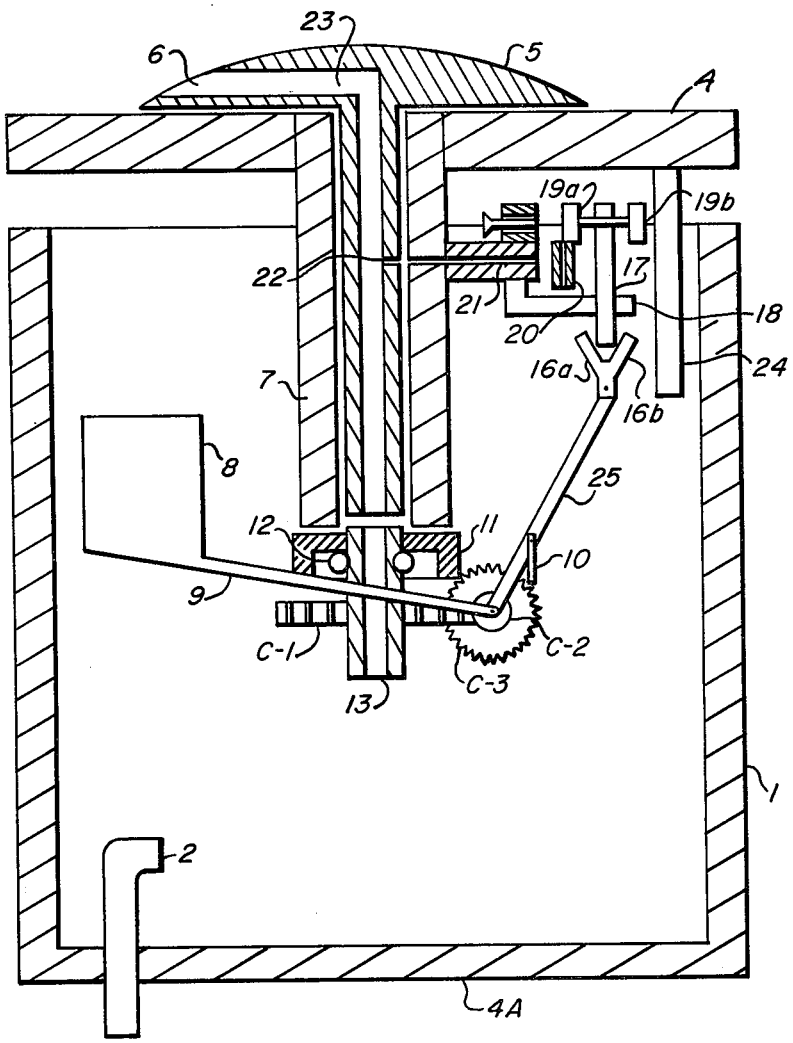
FIG. 1 is a side view, partially cut away, of a rotating jet assembly.

Referring more particularly to the drawings by characters of reference, FIG. 1 discloses a cylinder 1 having a removable top 4 and a bottom 4A. At a point near the bottom of the cylinder 1 is positioned a pipe 2 through which pressurized liquid enters cylinder 1. Inside of the cylinder 1 is a pipe 7 which is fixed to the top of cylinder 1 and extends downwardly therefrom inside of cylinder 1. Inside of pipe 7 is positioned a pipe 13 which extends outward of each end thereof. The pipe 13 is small enough to turn freely inside pipe 7. The upper end of pipe 13 is provided with a dome 5 having a nozzle 6 extending outwardly thereof. The lower end of pipe 13 is fitted with a washer 11 and an O-ring 12 which form a seal to prevent liquid from entering between the pipe 7 and pipe 13. Just below washer 11 and O-ring 12 and fixedly attached to pipe 13 is provided a gear C-1 to which is fitted in meshing engagement a drive gear C-2. Axially attached to the drive gear C-2 is fixed a notched wheel C-3. Axially attached to the notched wheel at its center in a pivotal manner to allow it to move in an up and down motion is an arm 9. At the end of the arm 9 is fixed a float 8. Fixed to the arm 9 near the center of the notched wheel C-3 is an arm 25. The upper end of arm 25 is provided with a Y-shaped configuration having arms 16*a* and 16*b*. At a point above the notched wheel C-3 and pivotally attached at one end thereof to arm 25 is an arm 10. The lower or free end of arm 10 fits into a notch on the wheel C-3. Between the Y-shaped arm 16*a* and 16*b* is an arm 17. The arm 17 is pivotally mounted to an arm 18 in a manner that will allow it to move toward and away from pipe 7. Fitted to the pipe 7 at a 90 degree angle therewith is a pipe 21. At the free open end of pipe 21 is mounted a cap 20. To the cap 20 is fixed two stops 19*a* and 19*b*. The two stops 19*a* and 19*b* are spacedly mounted on a rod far enough apart to allow the arm 17 to move a distance before coming in contact with either stop. The rod is slidably connected to pipe 21 in a manner so that it can move towards and away from pipe 7. This movement allows the cap 20 to open and close the open free end of pipe 21.

Figure 3:
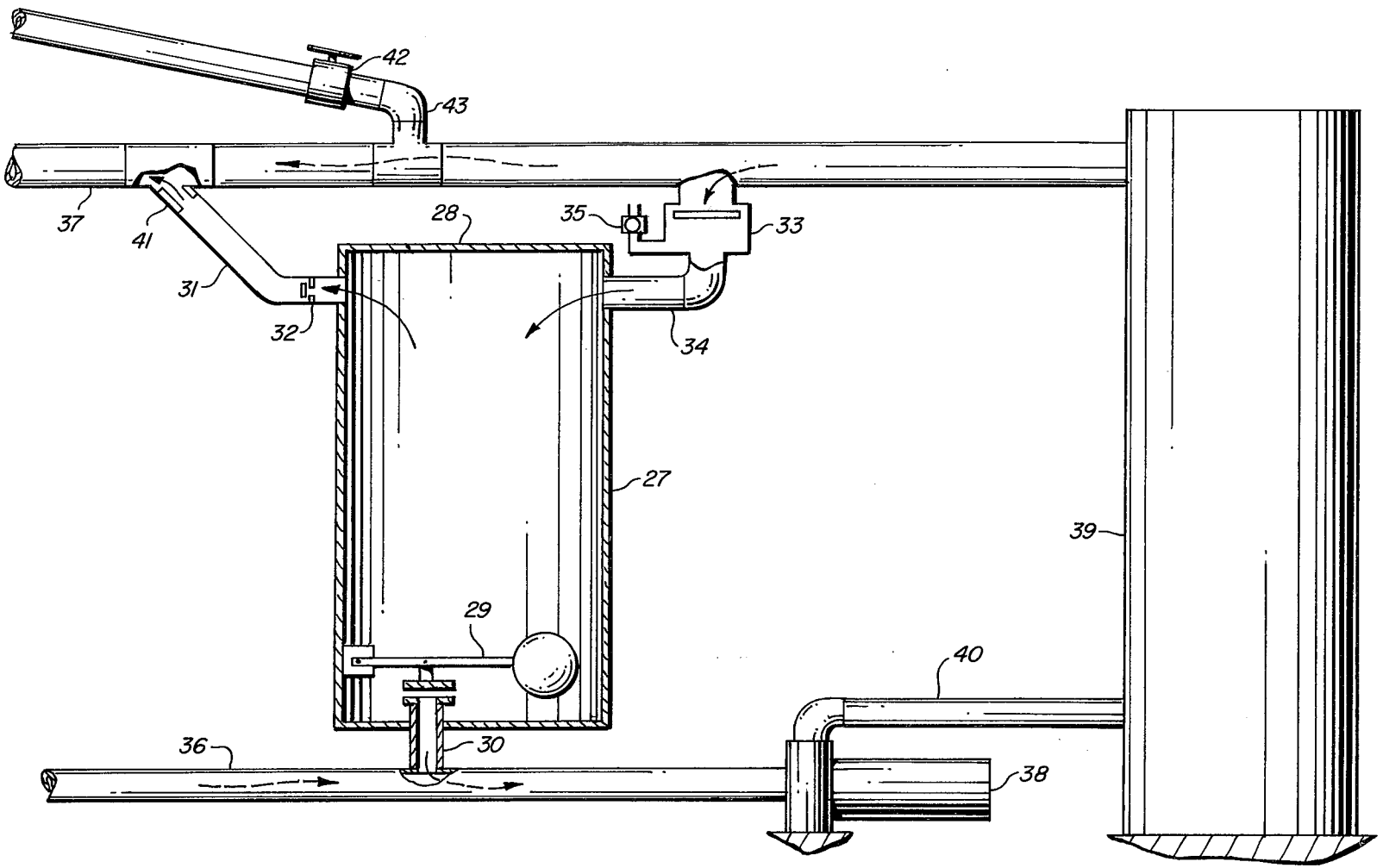
FIG. 3 is a side view of the air pump assembly with the filter and pump partially cut away.

As shown in FIG. 3, a pool filter 39 is connected to a standard pool pump 38 by a pipe 40. A suction pipe 36 is connected to the pump 38 and its other end is connected to the pool skimmer and drain, through which pool liquid is furnished to the pump. Filter 39 is connected to the pool by means of a pipe 37 which carries the liquid that has been filtered back to the pool jets. To pipe 37 is fixed pipe 43 which carries any liquid which is not needed to operate the jets back to the pool. Pipe 43 is fitted with a valve 42. The valve 42 controls the amount of liquid that flows through pipe 43, thereby regulating the pressure at the jet nozzle. Between pipe 37 and pipe 36 and set near the pump 38 is connected a cylinder 27. The cylinder 27 has a top 28 that is removable. Inside the cylinder 27 is a float valve 29 that is fitted to the side of the cylinder in a manner so that it can move up and down. Connected to the bottom of the cylinder 27 is a pipe 30. At the top of the cylinder 27 and to the near side of the filter 39 pipe 34 connects cylinder 27 to an electrical control valve 33. The electrical control valve 33 is connected to pipe 37. Connected to pipe 34 near valve 33 is a check valve 35. This check valve 35 will let air into pipe 34 but will not allow liquid to flow out. Connected to the far side of the cylinder 27 is a pipe 31. The other end of pipe 31 is connected to pipe 37. In pipe 31 between pipe 37 and cylinder 27 is a check valve 32 which will allow liquid or air out of the cylinder 27 but will not allow liquid to flow into cylinder 27. At the connections between pipe 31 and pipe 37 is a restriction 41 which extends at an angle into pipe 37.

Figure 4:
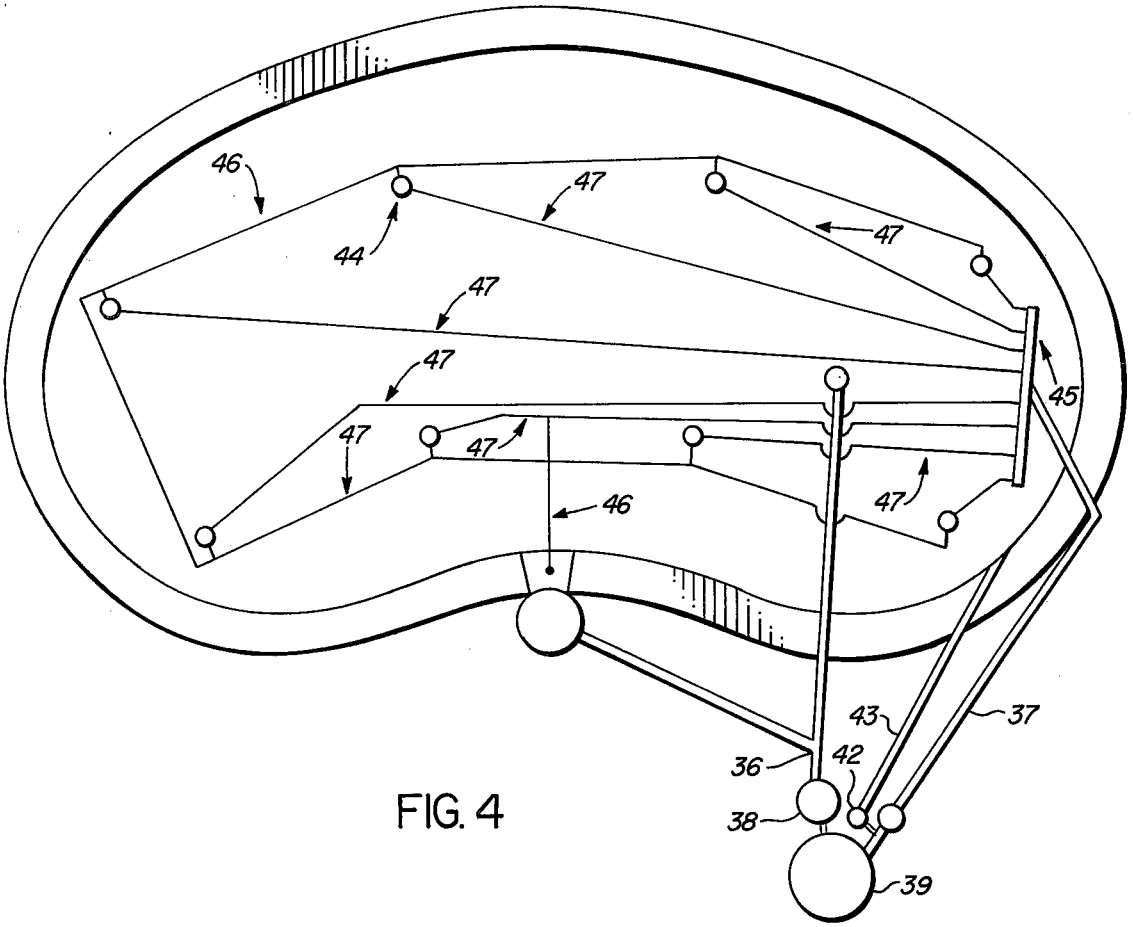
FIG. 4 is a top view of a pool with a filter, pump, skimmer, drain piping, air pump, return line piping and suggested jet locations.
Figure 2:
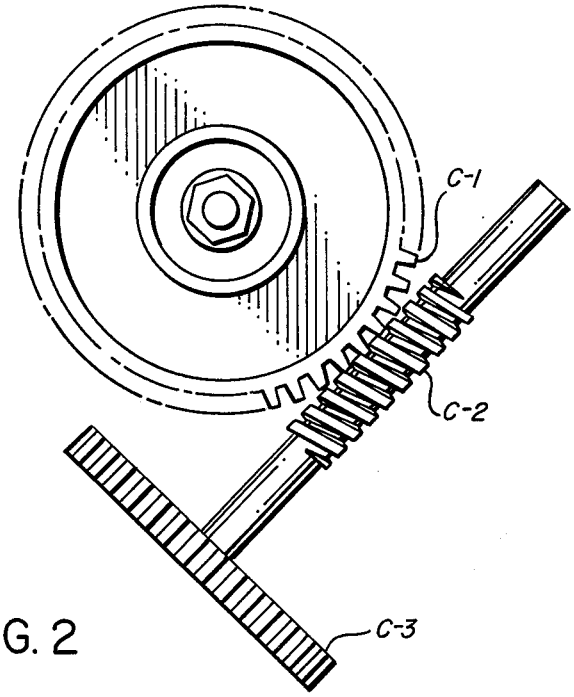
FIG. 2 is a bottom view of the gear drive shown in FIG. 1 that rotates the jet stream.

FIG. 4 diagrammatically illustrates the outline of a pool showing a coping 47 and employing a skimmer 45, a drain 46 with standard piping 36, a pump 38, a filter 39, air pump 27, jet piping 37, control valve 42 and the return pipe 43. Suggested locations for the rotating jets 44 on a large pool, for example 22' by 44', is shown. To clean pool liquid with this method, suitable fittings are attached to the interior surface of the pool and connected to a system of pressurized liquid, normally the return side of the pool filter, and normally all the jets are maintained on whenever the filter is in operation.

THE METHOD OF CLEANING

The pool filter pump 38 pulls the liquid from the skimmer and drain of the pool through pipe 36 to the pump 38. At the pump 38 the liquid is put under pressure and flows through filter 39 where dirt is removed. The liquid then flows back to the pool through pipe 37, to pipe 2 into cylinder 1 through pipe 13 and out nozzle 6 and across the pool surface thereby sweeping the interior surface of the pool.

After a time, for example, 15 seconds, the electric control valve 33 on the air pump opens. The opening and closing of the electric control valve 33 is accomplished by a suitable timing device such as those used on automatic washing machines. As valve 33 opens, pressure liquid enters pipe 34. The air valve 35 closes and cylinder 27 begins to fill with liquid. As cylinder 27 fills, the float valve 29 at the bottom of the cylinder opens. This is caused by the buoyancy of the float overcoming the suction of the pump through pipe 30. A portion of the liquid that enters cylinder 27 is allowed to pass through pipe 30 and on to pump 38. Since pipe 30 is smaller than pipe 34 more liquid will enter cylinder 27 than will flow out pipe 30 so cylinder 27 will fill to the top with liquid. After a time, for example, 15 seconds, the electrical control valve 33 will close and stop the pressurized liquid from entering cylinder 27. As pump 38 pulls the liquid out of the cylinder through pipe 30, the check valve 32 will close.

As the liquid is removed from cylinder 27 by pump 38 and with the check valve 32 closed and the electrical control valve 33 closed the pressure inside of the cylinder is lowered and the air valve 35 opens. As pump 38 withdraws liquid from the cylinder 27 it fills with air. As the liquid lowers down to the float valve 29 the float will lower and the valve will close. The closing of the float valve 29 will stop the air from going through pipe 30 to pump 38 where a loss of prime would occur from an air pocket at the pump impeller.

After a given time interval, for example 15 seconds, the electrical control valve will open and the low pressure inside the cylinder 27 will change to a high pressure so the air valve 35 will close as the liquid rises in the cylinder 27, the air that is trapped inside being pushed to the top of the cylinder and out through the check valve 32 into pipe 31 and through the restriction 41 in pipe 31 into pipe 37, through pipe 2 and into cylinder 1.

The restriction 41 is angularly positioned in pipe 37 so as to prevent an airlock from occurring in the cylinder by creating a slightly lower pressure at the outlet of restriction 41 than at the inlet of pipe 34. Most of the liquid, as it leaves the filter 39 flows to the jet nozzles through pipe 37. Only a small amount of liquid flows into cylinder 27 when valve 33 is open. As the air and liquid enters into cylinder 1 most of the fine air bubbles will rise to the top of cylinder 1 and the liquid will flow through pipe 13 and out the nozzle 6. As the air fills the top of cylinder 1 the liquid is lowered. As the liquid lowers, the float 8 an arm 9 are lowered. As arm 9 lowers, arm 25 which is connected to arm 9 moves upwardly. As arm 25 moves upwardly, one of the Y-shaped arms **16*b* moves to the arm 17. As arm 16*b* moves, arm 17 moves toward the air release valve stop 19*b*. As arm 17 moves stop 19*b* the valve cap 20 is open. This will allow the air that has accumulated in the upper part of cylinder 1 to flow through pipe 21 and enter the jet stream 22 in pipe 13. As the float is lowering and arm 25 is moved upwardly, arm 10 which is connected to arm 25 moves upwardly. As the arm 10 moves upwardly, the lower end steps over the notched wheel C-3 without moving the wheel. As the air leaves cylinder 1 the liquid will rise to the top of the cylinder again. This will cause the float 8 and the arm 9 to move upwardly. As the arm 9 moves upward, arm 25 moves downward. As arm 25 moves downwardly the Y-shaped arm 16*a* moves to the arm 17. As arm 16*a* moves, arm 17 moves to air release valve stop 19*a*. As arm 17 moves air release valve stop 19*a* moves valve cap 20 toward pipe 21. This will close the air valve cap and stop the flow of air to the jet stream. As arm 25 moves downwardly arm 10 locks in one of the notches of the notched wheel C-3, like a rachet. This will turn the notched wheel C-3 thereby turning the gear C-2 in turn turning the gear C-1 and thereby turning pipe 13. This action turns the jet nozzle and so rotating the jet stream. This cycle is then repeated over and over causing sequential 360 degree rotation of the dome B or head 5**.

The fittings described herein are not necessarily the only ones that could be used in this method of cleaning a pool. If, for example, it would be desired to fit a wall mounted jet, only the float 8 and the air release valve need to be changed. They would be set parallel to the side of the cylinder 1 instead of parallel to the top. This would allow the cylinder to be set in the wall of the pool. This method of aerating the liquid is not necessarily the only way. For example, an electric compressor could be employed or a standard pool pump may be used when fitted with a small pipe set near there is no space for an air pocket to accumulate. This structure should be fitted with a check valve so liquid will not leak out when the pump is off. It has been found that, for example, about 240 cubic inches or air per minute can be pulled into the liquid being pumped by a 1 horsepower standard pool pump without a substantial loss of pressure. The air would accumulate in the upper part of the pool filter and be released back to the pool return pipe by a standard automatic air release system which most modern filters have. Or, a separator tank between the pump and the filter with a release valve and pipe connected to the separator tank and the return water line could be employed.

In my tests it was found that a ½ inch diameter wheel C-1 with 24 evenly spaced notches and a gear ration of 24 to 1 between gear C-1 and gear C-3 would cause the jet stream to turn approximately 0.6 of one degree at a time. With an air cycle of 15 seconds the jet would rotate at a rate of 2.4 degrees per minute. The rotation of the jets can be changed either by changing the gear ratio or by changing the time between air cycles. The air pump cylinder inside area is determined by the total area of the float chambers times three. In my tests it was found that some of the air would exit out the nozzle without separating from the liquid. For example, if each jet cylinder had an area of 28 cubic inches and there were 6 cylinders, their would be 168 cubic inches times three, which would be 504 cubic inches in the air pump cylinder. For an average home pool, six jets set approximately 12′ apart is suggested. In the plumbing for the jets, it is suggested that a jet main pipe from the filter to the air pump and on to the center of the pool be installed. For an average home pool, this pipe would be an 1½″ or 2″ diameter. A tee fitting would be connected to the end of the pipe in a level horizontal position. The same number of individual jet pipes in a size of ¾″ to 1″ diameter would be connected to each side of said tee fitting and as close to the tee fitting as possible and then extend to the appointed place in the pool. The installation of the jet piping in this manner will let each jet get its right amount of air on each air cycle.

Although but one embodiment of the invention has been illustrated and described, it will be apparent to those skilled in the art that various changes and modifications may be made therein without departing from the spirit of the invention or from the scope of the appended claims.

What is claimed is:

1. A pool cleaning apparatus comprising:

nozzle means mounted in the surface of a pool for ejecting recirculating pool water therethrough, said nozzle means comprising a rotating head having an outlet port through which a jet stream of recirculating pool water is ejected, said nozzle means comprising a means for accumulating air from said recirculating pool water in said nozzle means and periodically releasing accumulated air through said outlet port, tubular means for connecting said nozzle means to the recirculating pool water, air injection means for accumulating air at a given point in the recirculating pool water and periodically ejecting this air into water being directed to said nozzle means through said tubular means, said air injection means for accumulating air comprising a first buoyant means reciprocating under pressure of the accumulating air to sequentially inject air into the recirculating water moving in the tubular means, a second buoyant means for periodically rotating said head upon a predetermined accumulation of the air in said nozzle means, and gear means interconnecting said second buoyant means and said head for rotating said head upon predetermined movement of said second buoyant means.

2. The pool cleaning apparatus set forth in claim 1 wherein:

said means for accumulating and releasing air causes sequentially 360 degree rotation of said rotating head.

3. The pool cleaning apparatus set forth in claim 1 wherein:

said air injection means comprises an electric control valve for periodically causing said air injection means to operate.

* * * * *